US010975716B2

(12) United States Patent
Scholtes et al.

(10) Patent No.: US 10,975,716 B2
(45) Date of Patent: Apr. 13, 2021

(54) ASSEMBLY FORMING A LABYRINTH SEAL FOR A TURBOMACHINE COMPRISING AN ABRADABLE MATERIAL AND INCLINED FINS

(71) Applicant: SAFRAN AIRCRAFT ENGINES, Paris (FR)

(72) Inventors: Christophe Scholtes, Vaux-le-Penil (FR); Antoine Robert Alain Brunet, Avon (FR); Wilfried Lionel Schweblen, Chateaubleau (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 18 days.

(21) Appl. No.: 16/326,243

(22) PCT Filed: Aug. 23, 2017

(86) PCT No.: PCT/FR2017/052266
§ 371 (c)(1),
(2) Date: Feb. 18, 2019

(87) PCT Pub. No.: WO2018/037190
PCT Pub. Date: Mar. 1, 2018

(65) Prior Publication Data

US 2019/0186282 A1 Jun. 20, 2019

(30) Foreign Application Priority Data

Aug. 25, 2016 (FR) ..... 1657928

(51) Int. Cl.
*F01D 11/12* (2006.01)
*F01D 11/02* (2006.01)
*F01D 11/00* (2006.01)

(52) U.S. Cl.
CPC ..... *F01D 11/122* (2013.01); *F01D 11/02* (2013.01); *F01D 11/025* (2013.01); *F01D 11/001* (2013.01); *F05D 2240/55* (2013.01)

(58) Field of Classification Search
CPC ..... F01D 11/001; F01D 11/02; F01D 11/025; F01D 11/122; F05D 2240/55; F16J 15/477; F16J 15/4472; F16J 15/4474
See application file for complete search history.

(56) References Cited

U.S. PATENT DOCUMENTS 4,513,975 A * 4/1985 Hauser ..... F01D 11/02 277/415
5,281,090 A * 1/1994 Starling ..... F01D 11/02 277/413

(Continued)

FOREIGN PATENT DOCUMENTS

FR 2930593 A1 10/2009
FR 2977274 A1 1/2013

(Continued)

OTHER PUBLICATIONS

Search Report issued in French Patent Application No. 1657928 dated Apr. 12, 2017.

(Continued)

*Primary Examiner* — Nathaniel E Wiehe
*Assistant Examiner* — Ryan C Clark
(74) *Attorney, Agent, or Firm* — Pearne & Gordon LLP

(57) ABSTRACT

Assembly forming a labyrinth seal for a turbomachine, comprising: at least one abradable material of which the inner surface defines a stair shape with a sequence of treads and risers; a plurality of fins extending radially toward said inner surface, the fins each comprising, at least in part, an upstream side wall forming a riser facing the corresponding fin such that, when seen in axial cross-section, the tangent at the top of the upstream side wall of at least one fin and the (Continued)

straight line passing through the downstream side wall of said at least one abradable material intersect, the angle between said tangent and said straight line being strictly between 5 and 15°.

9 Claims, 1 Drawing Sheet

(56) References Cited

U.S. PATENT DOCUMENTS

| | | | | |
|---|---|---|---|---|
| 5,639,095 | A * | 6/1997 | Rhode | F16J 15/4472 277/303 |
| 5,984,314 | A | 11/1999 | Peters et al. | |
| 8,167,547 | B2 * | 5/2012 | Wu | F01D 11/001 277/418 |
| 8,402,770 | B2 | 3/2013 | Garin et al. | |
| 9,353,640 | B2 * | 5/2016 | Kuwamura | F01D 11/10 |
| 10,138,745 | B2 | 11/2018 | Scholtes | |
| 10,316,675 | B2 * | 6/2019 | Kuwamura | F01D 11/02 |
| 2008/0124215 | A1 * | 5/2008 | Paolillo | F01D 11/001 415/173.7 |
| 2008/0258404 | A1 * | 10/2008 | Pillhoefer | C23C 10/02 277/415 |
| 2009/0067997 | A1 | 3/2009 | Wu et al. | |
| 2011/0070074 | A1 * | 3/2011 | Schabowski | F01D 11/08 415/174.5 |
| 2012/0043728 | A1 * | 2/2012 | Zeng | F16J 15/4472 277/412 |
| 2016/0130969 | A1 * | 5/2016 | Gold | B22F 3/1055 415/173.4 |
| 2016/0333717 | A1 * | 11/2016 | Strock | F01D 5/282 |
| 2017/0130601 | A1 * | 5/2017 | Coutandin | F01D 9/02 |
| 2018/0163740 | A1 * | 6/2018 | Scholtes | F04D 29/542 |
| 2018/0209291 | A1 | 7/2018 | Scholtes | |

FOREIGN PATENT DOCUMENTS

| | | |
|---|---|---|
| FR | 3027343 A1 | 4/2016 |
| GB | 2242710 A | 10/1991 |

OTHER PUBLICATIONS

International Search Report issued in Application No. PCT/FR2017/052266 dated Nov. 24, 2017.

Written Opinion issued in Application No. PCT/FR2017/052266 dated Nov. 24, 2017.

* cited by examiner

ASSEMBLY FORMING A LABYRINTH SEAL FOR A TURBOMACHINE COMPRISING AN ABRADABLE MATERIAL AND INCLINED FINS

This is the National Stage application of PCT international application PCT/FR2017/052266, filed on Aug. 23, 2017 entitled "ASSEMBLY FORMING A LABYRINTH SEAL FOR A TURBOMACHINE COMPRISING AN ABRADABLE MATERIAL AND INCLINED FINS", which claims the priority of French Patent Application No. 16 57928 filed Aug. 25, 2016, both of which are incorporated herein by reference in their entirety.

TECHNICAL FIELD

The present invention relates to the field of turbomachines, and more particularly to the general field of labyrinth seal type sealing systems for sealing between two elements of a turbomachine rotating with respect to each other. More precisely, it relates to a labyrinth seal assembly for a turbomachine, as well as the compressor and the turbomachine including such an assembly.

The invention is applicable to any type of terrestrial or aeronautic turbomachines, and in particular to aircraft turbomachines such as turbofan engines and turboprop engines. More preferentially, the invention can be applied to a twin shaft turbofan engine.

STATE OF PRIOR ART

In the field of turbomachines, there are different types of sealing systems for sealing between two parts of the turbomachine.

Such a sealing is for example required under a compressor diffuser of a turbomachine. Indeed, the permeability of the cavities under diffusers, that is their ability to avoid too strong an air recirculation under a diffuser, primarily impacts the compressor performance. But the difficulty in ensuring a proper sealing level is related to the fact that both parts of the turbomachine, in particular the rotor and the case for the case of the diffuser, are moved independently of each other with relatively significant mechanical and thermal deformations during a conventional operation of the engine, thus allowing some clearance and leakage losses to appear in use. The same issue is also found for the case of the turbine nozzles of a turbomachine or even at the apex of runners.

Among known sealing systems, "contactless" sealing systems of the labyrinth seal types are particularly distinguished, which are characterised by the absence of contact between the parts of the turbomachine, except optionally during particular events as significant unbalance levels or severe operations of the turbomachine. The labyrinth seals are indeed conventionally used on turbomachines and in general positioned at the diffuser roots.

A labyrinth seal conventionally comprises a rotating part with lips, or fins, with a static bore covered with a gasket of an abradable material or a honeycomb structure capable of withstanding high temperatures.

Upon starting the turbomachine, the lips of the labyrinth seal slightly rub against the gasket of abradable material, gripping the same, which results in a minimum gap. This clearance varies during the different flight cycles, depending on the expansion of the parts and the natural flexibility of the movable parts.

The lips enable aerodynamic sealings between air enclosures to be ensured under different pressures. They are generally located on the rotor part facing stator parts covered with the gasket of abradable material. They mainly consist of "blades" which are annular-shaped, continuous or segmented in the circumferential direction, and can be directed radially inwardly or outwardly.

In particular, when they have a continuous shape, the lips are likely to contact the stator in some operational configurations. To avoid their destruction under some situations, the stators are equipped with coatings allowing interface and which are called "abradables". In this case, the usual sequences of penetrating into the abradables by the lips consist of a radial cutting associated with an axial movement ("sliding").

During recent years, improvements have been made to the labyrinth seals and new concepts have appeared, as that of labyrinth seals comprising inclined lips and staged abradable materials, as taught for example in French patent applications FR 2 930 593 A1 and FR 2 977 274 A1. Advantageously, this concept enables permeability to be significantly reduced.

US patent application 2009/0067997 A1 has provided on the other hand a system with a staged honeycomb abradable the sidewalls of which are parallel to the lips. This improvement enables a further reduction in permeability, and thus an improvement in the turbomachine efficiency to be achieved.

However, this system has a major drawback insofar as, during an axial movement of the rotor or the case, the contact between abradable and lips can occur. In this case, the contact surface area is very high because of the parallelism of both contacting surfaces. The power generated, proportional to the contact surface area, is thus all the more important.

The risks for the engine are thereby of two types. On the one hand, achieving a strong air heating in the cavities under the diffuser can damage the lips, the rotor shell or the diffuser, and can cause the occurrence of microfissures, or even cracks. On the other hand, the occurrence of a thermal divergence phenomenon: under the effect of the temperature increase, the rotor is strongly expanded and penetrates more deeply in the abradable increasing the contact surface area and propagating the phenomenon until the same is fully worn. The phenomenon can additionally be propagated to the other compressor stages until the module is fully destructed.

DISCLOSURE OF THE INVENTION

Thus, one purpose of the invention is to overcome at least partially the abovementioned needs and drawbacks relating to the embodiments of prior art.

In particular, the invention aims at providing a labyrinth seal system which both enables gains related to inclined abradable walls to be preserved but which avoids too high a heating risk during a contact between lips and abradable.

Thus, one object of the invention, according to one of its aspects, is a labyrinth seal assembly for a turbomachine, for sealing between two elements of the turbomachine rotating with respect to each other, in particular between a rotor and a stator of the turbomachine or between two rotors of the turbomachine, having in particular different speeds of rotation, and revolving about an axis of the seal assembly, including:

at least one abradable material, annular about the axis of the labyrinth seal assembly, for being carried by one of both elements of the turbomachine rotating with respect to each other, said at least one abradable material being referred to as "staged", its internal surface defining, in an axial cross-section, a stair shape with alternating steps and risers, a plurality of lips, annular about the axis of the labyrinth seal assembly, radially extending towards the internal surface of said at least one abradable material, for being carried by the other of both elements of the turbomachine rotating with respect to each other, the lips each including, at least partly, an upstream sidewall at least partially facing a downstream sidewall of said at least one abradable material forming a riser facing the corresponding lip, characterised in that, by observation in an axial cross-section, the tangent to the apex of the upstream sidewall of at least one lip and the straight line passing through the downstream sidewall of said at least one abradable material, facing said at least one lip, are secant, the angle between said tangent and said straight line being strictly between 5 and 15°.

Advantageously, the choice of an angle between said tangent and said straight line strictly between 5 and 15° is a compromise between sealing gain by friction, restriction effect, manufacture and mechanical strength. The aim is indeed to finely choose the angle interval of the lip faces and the abradable material so as to manage contacts at best.

In particular, if the inclined face of the abradable material is too sharp, then the manufacture is made complex and the mechanical strength is no longer ensured, with in particular a lot of wear of the tip by erosion, and thus the gain is lost.

Likewise, if the inclined face of the abradable material is not inclined enough, there is no gain related to the change of the flow structures which increases friction, and thus improves the sealing efficiency. The choice of the angle range according to the invention is herein a good compromise because, in addition to force the flow to be rubbed, it creates a new restriction which further limits air circulation.

In addition, if the inclined face of abradable material is exactly as that of the lip, thereby in case of contact, there is a very large contact surface area and thus a lot of air heating, and consequently of the surrounding parts.

In other words, advantageously, an angle strictly between 5 and 15° makes it possible to have a sealing gain while limiting mechanical risks, for example in manufacturing or in use, and in case of contact.

The labyrinth seal assembly according to the invention can further include one or more of the following characteristics taken alone or according to any technically possible combinations.

Said tangent and the axis of the labyrinth seal assembly can advantageously form together an angle strictly lower than 90°. Likewise, said straight line and the axis of the labyrinth seal assembly can advantageously form together an angle strictly lower than 90°.

According to a first concept of the invention, said tangent and the axis of the labyrinth seal assembly can form together an angle strictly higher than the angle formed by said straight line and the axis of the labyrinth seal assembly. In this case, the downstream sidewall of said at least one abradable material is more inclined than the upstream sidewall of the lip.

According to a second concept of the invention, said tangent and the axis of the labyrinth seal assembly can form together an angle strictly lower than the angle formed by said straight line and the axis of the labyrinth seal assembly. In this case, the downstream sidewall of said at least one abradable material is less inclined than the upstream sidewall of the lip.

At least two lips, in particular all the lips, including an upstream sidewall at least partially facing a downstream sidewall of said at least one abradable material can be such that, by observation in axial cross-section, the tangent to the apex of the upstream sidewall and the straight line passing through the downstream sidewall of said at least one abradable material, facing the corresponding lip, are secant, the angle between said tangent and said straight line being strictly between 5 and 15°.

Said at least one abradable material can be smooth. In particular, said at least one abradable material is advantageously of a very low roughness. It is particularly different from a honeycomb abradable material.

The angle α, β between said tangent and said straight line can particularly meet the following relationship:

$$\alpha \text{ or } \beta = \arctan(P_{adm}/(\pi \times r \times K \times V^2)),$$

in which:

α or β designates the angle between said tangent and said straight line, $P_{adm}$ corresponds to the permissible limit output power by the turbomachine during a contact between the lip and said at least one abradable material, r corresponds to the radius at said contact, π is the constant of Pi, K is the empiric parameter integrating the properties of the materials of the lip and of said at least one abradable material, V corresponds to the axial movement speed of the part carrying the lips relative to the part carrying said at least one abradable material.

Preferably, the lips are axially evenly spaced apart. Moreover, the lips are preferentially of identical shapes.

Another object of the invention is, according to another of its aspects, a turbomachine compressor, in particular a high pressure compressor, characterised in that it includes a seal assembly as defined previously.

Another object of the invention is additionally, according to another of its aspects, a turbomachine, characterised in that it includes a compressor as defined previously or a labyrinth seal assembly as defined previously.

The labyrinth seal assembly enables sealing to be ensured between two elements of the turbomachine rotating with respect to each other, in particular between a rotor and a stator of the turbomachine or between two rotors of the turbomachine, having in particular different speeds of rotation.

The lips can be carried by a rotor of the turbomachine and said at least one abradable material can be carried by a stator of the turbomachine. Reversely, the lips can be carried by a stator of the turbomachine and said at least one abradable material can be carried by a rotor of the turbomachine. The lips can further be carried by a rotor of the turbomachine and said at least one abradable material can be carried by another rotor of the turbomachine, having in particular a different speed of rotation.

BRIEF DESCRIPTION OF THE DRAWINGS

The invention will be better understood upon reading the detailed description that follows, of exemplary non-limiting implementations of the same, as well as upon examining the schematic and partial figures of the appended drawing, in which.

Throughout these figures, identical references can designate identical or analogous elements.

In addition, the different parts represented in the figures are not necessarily drawn to a uniform scale, to make the figures more readable.

DETAILED DISCLOSURE OF PARTICULAR EMBODIMENTS

Figure 1:
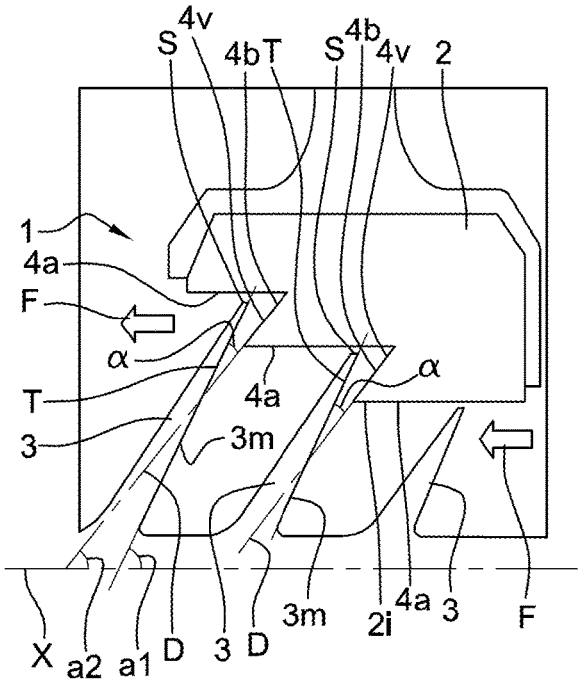
FIGS. 1 and 2 represent, in an axial cross-section, two distinct exemplary embodiments of labyrinth seal assemblies according to the invention.
Figure 2:
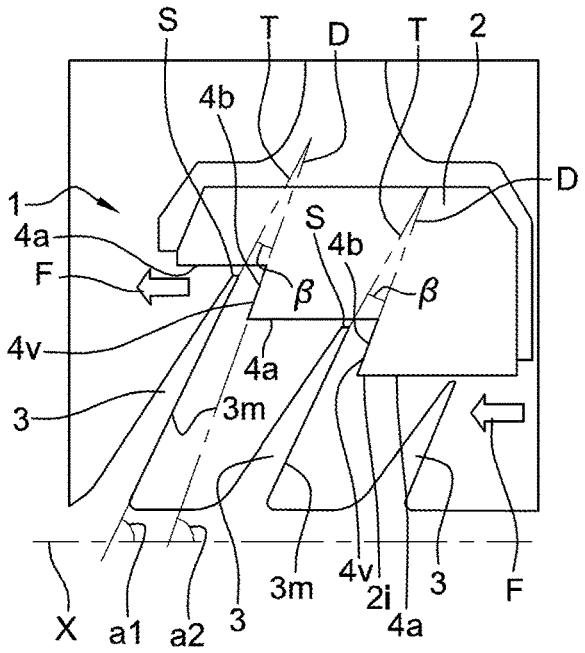

Throughout the description, it is noted that the terms upstream and downstream are to be considered with respect to a main direction F, represented in FIGS. 1 and 2, of normal flow of the gases (from upstream to downstream) for a turbomachine. Additionally, the axis X of the labyrinth seal assembly 1 designates the axis of radial symmetry of the labyrinth seal assembly 1. The axial direction of the labyrinth seal assembly 1 corresponds to the direction of the axis X of the labyrinth seal assembly 1. A radial direction of the labyrinth seal assembly 1 is a direction perpendicular to the axis X of the labyrinth seal assembly 1. Further, unless otherwise set out, the adjectives and adverbs axial, radial, axially and radially are used in reference to the abovementioned axial and radial directions. Moreover, unless otherwise set out, the terms internal and external are used in reference to a radial direction such that the internal part of an element is closer to the axis X of the labyrinth seal element 1 than the external part of the same element.

In reference to FIGS. 1 and 2, two concepts of embodiment of a labyrinth seal assembly 1 according to the invention are represented.

Advantageously, according to these two concepts, the abradable material 2 with a "staged" shape has downstream sidewalls 4*v* which are inclined, as well as the upstream sidewalls 3*m* of the lips 2, but the respective inclinations of the abradable material 2 and the lips 2 are not parallel to each other. In this way, the previously set forth drawbacks of prior art are avoided.

In a common manner to both exemplary embodiments of FIGS. 1 and 2, the labyrinth seal assembly 1 includes an abradable material 2, annular about the axis X of the assembly 1, and for being carried, for example, by a compressor case of a turbomachine.

This abradable material 2 is of "staged" type, that is its internal surface 2*i* defines, in an axial cross-section, a stair shape with alternating steps 4*a* and risers 4*b*. Moreover, this abradable material 2 is smooth, and thus different from the honeycomb material.

On the other hand, the labyrinth seal assembly 1 also includes a plurality of lips 3, here three lips 3, extending radially towards the internal surface 2*i* of the abradable material 2, and for being carried, for example, by a compressor rotor of a turbomachine.

The first two lips 3 further include an upstream sidewall 3*m* partially facing a downstream sidewall 4*v* of the abradable material 2 forming a riser 4*b* facing the corresponding lip 3.

In accordance with the invention, the assembly 1 is characterised in that, by observation in an axial cross-section, the tangent T to the apex S of the upstream sidewall 3*m* of a lip 3 and the straight line D passing through the downstream sidewall 4*v* of the abradable material 2, facing the lip 3, are secant, the angle α or β between said tangent T and said straight line D being strictly between 5 and 15°.

More precisely, according to the first concept of the invention represented in FIG. 1, the risers 4*b* of the abradable material 2 are more inclined than the lips 3. Thus, said tangent T and the axis X of the labyrinth seal assembly 1 form together an angle a1 strictly higher than the angle a2 formed by said straight line D and the axis X of the labyrinth seal assembly 1. To have a good compromise between efficiency and heating of the turbomachine, the angle α meets the following relationship:

$$5°<\alpha<15°.$$

According to the second concept of the invention represented in FIG. 1, the risers 4*b* of the abradable material 2 are less inclined than the lips 3. Moreover, said tangent T and the axis X of the labyrinth seal assembly 1 form together an angle a1 strictly lower than the angle a2 formed by said straight line D and the axis X of the labyrinth seal assembly 1. To have a good compromise between efficiency and heating of the turbomachine, the angle β meets the following relationship:

$$5°<\beta<15°.$$

Figure 3:
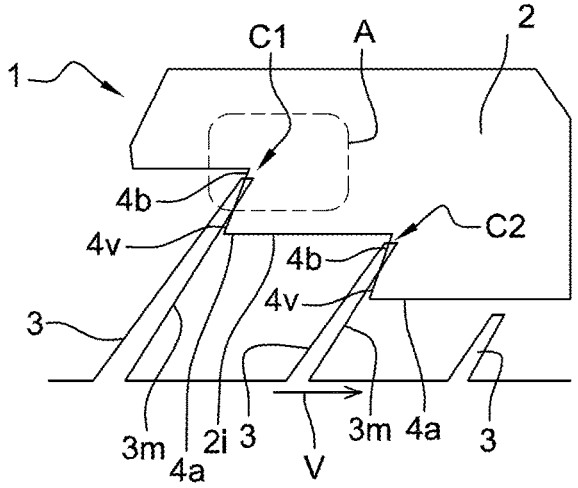
FIG. 3 illustrates the case of a contact between the lips and the abradable material of a labyrinth seal assembly according to the invention.
Figure 3A:
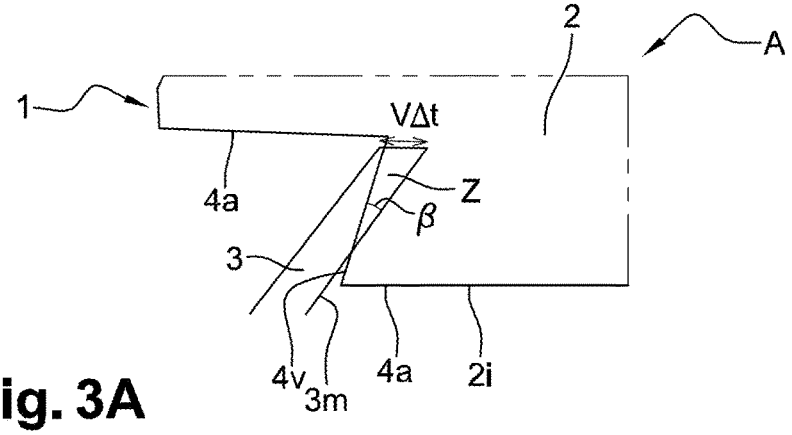
FIG. 3A is an enlarged view along A of FIG. 3.

On the other hand, FIGS. 3 and 3A relate to the case of contacts C1 and C2 between the lips 3 and the abradable material 2, in order to be able to determine dimensioning criteria.

First, it is to be noted that the lower the angle α or β, the better sealing.

The power P output from the contact C1 or C2 between lip 3 and abradable 2 is proportional to the abradable amount 2 lost per unit time, designated by Δt. The influencing parameters are thus the following ones: the speed of axial movement of the rotor relative to the case, called V (sliding speed); and the properties of the materials forming the lips 3 and the abradable 2.

The output power P is then:

for the first concept of FIG. 1:

$$P=\pi\times r\times K\times V^2/\tan(\alpha),$$

for the second concept of FIG. 2:

$$P=\pi\times r\times K\times V^2/\tan(\beta).$$

where:

K is a term empirically obtained which integrates the properties of the materials of the lips 3 and the abradable 2, r is the radius at the contact C1 or C2, π is the constant of Pi.

Within the scope of the turbomachine design, if these parameters are known, the criterion to be met is thus the following one:

$$\pi\times r\times K\times V^2/\tan(\alpha)<P_{adm}.$$

$$\pi\times r\times K\times V^2/\tan(\beta)<P_{adm}.$$

where $P_{adm}$ is the limit permissible output power for the turbomachine.

Further, in FIG. 3A, the contact zone Z has a contact surface area in the plane equal to $V^2\times\Delta t^2/(2\times\tan((3))$.

By integrating the sealing and output power criteria, the optimum values of the angles α and μ are thus the following ones:

$$\alpha=\arctan(P_{adm}/(\pi\times r\times K\times V^2),$$

$$\beta=\arctan(P_{adm}/(\pi\times r\times K\times V^2).$$

Of course, the invention is not limited to the exemplary embodiments just described. Various modifications can be made thereto by those skilled in the art.

In particular, it is possible to apply simultaneously the first and second concepts discussed in connection with FIGS. 1 and 2 on a same labyrinth seal assembly in accordance with the invention, by applying different concepts depending on the lips.

What is claimed is:

1. A labyrinth seal assembly for a turbomachine, for sealing between two elements of the turbomachine rotating with respect to each other and revolving about an axis of the labyrinth seal assembly, including:

at least one abradable material, annular about the axis of the labyrinth seal assembly, for being carried by one of both elements of the turbomachine rotating with respect to each other, the internal surface of said at least one abradable material defining, in an axial cross-section, a stair shape with alternating steps and risers, a plurality of lips, annular about the axis of the labyrinth seal assembly, extending radially towards the internal surface of said at least one abradable material, for being carried by the other of both elements of the turbomachine rotating with respect to each other, the lips each including, at least partly, a contacting surface of an upstream sidewall at least partially facing a mating contacting surface of a downstream sidewall of said at least one abradable material forming a riser facing the corresponding lip, wherein, by observation in an axial cross-section, the tangent to the apex of the contacting surface of the upstream sidewall of at least one lip and a straight line passing through the mating contacting surface of the downstream sidewall of said at least one abradable material, facing said at least one lip intersect, angle between said tangent and said straight line being strictly between 5 and 15° and at least one of the contacting surfaces of the plurality of lips contacts the at least one mating contact surface of the downstream sidewall of the at least one abradable material at an angle between 5 and 15°.

2. The assembly according to claim 1, wherein said tangent and the axis of the labyrinth seal assembly form together an angle strictly lower than 90°, and wherein said straight line and the axis of the labyrinth seal assembly form together an angle strictly lower than 90°.

3. The assembly according to claim 1, wherein said tangent and the axis of the labyrinth seal assembly form together an angle strictly higher than the angle formed by said straight line and the axis of the labyrinth seal assembly.

4. The assembly according to claim 1, wherein said tangent and the axis of the labyrinth seal assembly form together an angle strictly lower than the angle formed by said straight line and the axis of the labyrinth seal assembly.

5. The assembly according to claim 1, wherein at least two lips, including an upstream sidewall at least partially facing a downstream sidewall of said at least one abradable material are such that, by observation in an axial cross-section, the tangent to the apex of the upstream sidewall and the straight line passing through the downstream sidewall of said at least one abradable material, facing the corresponding lip intersect, the angle between said tangent and said straight line being strictly between 5 and 15°.

6. The assembly according to claim 1, wherein said at least one abradable material is smooth.

7. A compressor of a turbomachine, including a labyrinth seal assembly according to claim 1.

8. A turbomachine including a compressor according to claim 7.

9. A turbomachine including a labyrinth seal assembly according to claim 1.

* * * * *